US006202552B1

(12) United States Patent
Billington, III

(10) Patent No.: US 6,202,552 B1
(45) Date of Patent: Mar. 20, 2001

(54) ADJUSTABLE PRINTING PRESS

(75) Inventor: Charles J. Billington, III, Modesto, CA (US)

(73) Assignee: Billington Welding & Manufacturing, Inc., Modesto, CA (US)

( * ) Notice: Subject to any disclaimer, the term of this patent is extended or adjusted under 35 U.S.C. 154(b) by 0 days.

(21) Appl. No.: 09/233,924

(22) Filed: Jan. 20, 1999

(51) Int. Cl.[7] ..... B05C 17/06
(52) U.S. Cl. ..... 101/126; 101/115; 101/123
(58) Field of Search ..... 101/114, 115, 101/123, 126, 127.1, 129, DIG. 36

(56) References Cited

U.S. PATENT DOCUMENTS 4,669,378 * 6/1987 Lee ..... 101/115
4,753,161 * 6/1988 Kimball ..... 101/35
4,949,635 * 8/1990 Padula ..... 101/115
4,974,508 * 12/1990 Andersen et al. ..... 101/115
5,094,160 * 3/1992 Jennings ..... 101/127.1
5,315,929 * 5/1994 Sundqvist ..... 101/127.1
5,445,075 * 8/1995 Panipinto ..... 101/127.1

OTHER PUBLICATIONS

Hopkins/BWM's "6–Axis Hopkins" brochure.

* cited by examiner

*Primary Examiner*—Ren Yan
(74) *Attorney, Agent, or Firm*—Flehr Hohbach Test Albritton & Herbert LLP

(57) ABSTRACT

A printing press (10) including a pallet arm assembly (20) having a first arm extension (26) and a second arm extension (28) and an adjustable coupling (30) therebetween. Adjustment of coupling (30) adjusts the lateral and vertical position of a pallet table (22) carried by the pallet arm assembly. The printing press (10) also includes an angularly adjustable press arm bracket mount (60) that is mounted on a rotatable wheel (16) that carries multiple press arm assemblies (18). Adjustment of the angular position of bracket (60) assists in lowering press arm assembly (18) into a yoke gate (36) mounted on pallet arm assembly (20). Press arm assemblies (18) also include over-center spring mechanisms (90) that place a coil spring in compression rather than tension and include an enclosure (104) for capturing the coil spring for increased safety.

16 Claims, 7 Drawing Sheets

ADJUSTABLE PRINTING PRESS

TECHNICAL FIELD

The present invention pertains to screen printing equipment and more particularly to adjustable press arms and pallet arms that carry screen presses and pallets used to screen print articles.

BACKGROUND OF THE INVENTION

Screen printing of T-shirts and other articles of clothing and the like more and more requires precise positioning of the pattern screen over the article to be printed due to the greater resolution of screens and the attendant need to achieve close tolerance, accurate alignment and positioning of each high tension color screen for optimum color and resolution. It is also important to be able to repeatedly achieve accurate positioning in order to produce consistent prints.

Hopkins/BWM of Modesto, California, USA provides screen printing equipment including 4/6 and 8-color convertible presses, as is disclosed in Hopkins/BWM's "6-Axis Hopkins" brochure. The present invention improves upon the adjustability of the press arm and pallet arm components that assist in properly aligning the pallet table with the screen press.

DISCLOSURE OF THE INVENTION

Briefly described, the screen printing press of the present invention includes a pallet arm assembly for supporting a pallet table for screen printing of articles, with the pallet arm assembly having a first arm for mounting to a base structure of a screen printing press, a second arm for supporting the pallet table, and an adjustable coupling joining the first and second arms. The first arm extends outwardly from the base structure and the adjustable coupling includes a support member secured at the outer end of the first arm and a cover member secured at the inner end of the second arm. The cover member overlies the support member and is adjustable both laterally and vertically with respect to the support member.

The adjustment provided by the adjustable coupling provides an easy to use mechanism for leveling the pallet table with respect to the press arm assemblies that carry printing screens.

According to an aspect of the invention, the adjustable coupling includes adjustable set screws that adjustably position the cover member vertically and laterally with respect to the support member. Preferably, the set screws include generally vertically aligned set screws and generally laterally aligned set screws, for making the lateral and vertical adjustments independent of one another.

According to another aspect of the invention, the adjustable coupling further includes clamp bolts for tightly securing the cover member to the support member once adjusted in position by the set screws. Preferably, a clamp bolt is provided adjacent each set screw.

According to another aspect of the invention, the screen printing press includes a bracket mount for a press arm assembly of the screen printing press, with the bracket mount having a pivotal mount for securing an end of the press arm assembly in a pivotal manner to a rotatable wheel that carries the bracket mount. The pivotal mount provides angular movement of the press arm assembly from a raised position over a pallet table of the screen printing press to a lowered position where a gate catches the press arm assembly and positions the press arm assembly over the pallet table. The bracket mount further includes an adjustable coupling for securing the bracket mount to the wheel in a manner that permits a degree of angular movement of the bracket mount so that the press arm assembly can be angularly repositioned to fit into the gate when the press arm assembly is lowered.

According to an aspect of the invention, the adjustable coupling slots are in one of the bracket mount and the wheel, and the bolts are secured to the other of said bracket mount and wheel. The bolts extend through the slots and the slots are arcuate to provide for angular movement of the bracket mount.

Preferably, the slots are formed in the bracket mount and the bolts are secured to the wheel. With this design, the bolts include enlarged heads that are positioned above the bracket mount surface so that the heads prevent lifting of the bracket mount from the wheel.

According to another aspect of the invention, the bracket mount further comprises a bushing secured between the bracket mount and the wheel for providing low friction angular movement of the bracket mount. Preferably, the bushing is arcuate in shape.

According to another aspect of the invention, the screen printing press includes an over-center spring mechanism for biasing a pivoting component of a press arm assembly that pivots about a pivot point on a fixed component of the press arm assembly. The spring mechanism includes an extendable linkage that is pivotally secured at each of its ends to the pivoting component and the fixed component, with its ends on opposite sides of said pivot point. The extendable linkage includes a coil spring mounted for compression upon extension of the linkage.

According to an aspect of this embodiment of the invention, the linkage includes an enclosure for capturing the coil spring. Preferably, the enclosure has sufficient structural rigidity to contain the coil spring should the coil spring fail.

According to another aspect of this embodiment of the invention, the linkage includes a rod having one end pivotally secured to the pivoting component, with the rod adapted to capture one end of a coil spring, and an enclosure for capturing the other end of the coil spring, with the enclosure being pivotally secured to the fixed component. The rod and the enclosure are coupled together and are linearly movable with respect to each other to form an extendable linkage between the pivoting component and the fixed component. Whereby, movement of the extendable linkage past the pivot of the pivoting component causes the coil spring to compress.

Preferably, the rod includes a stop near the fixed component for capturing one end of a coil spring, and the enclosure is pivotally secured to the fixed component at a point spaced from the pivot point of the pivoting component.

BRIEF DESCRIPTION OF THE DRAWINGS

Throughout the several views, like reference numerals refer to like parts, wherein.

DETAILED DESCRIPTION OF THE INVENTION

Reference will now be made in detail to the preferred embodiments of the invention, examples of which are illustrated in the accompanying drawings. While the invention will be described in conjunction with the preferred embodiments, it will be understood that the described embodiments are not intended to limit the invention specifically to those embodiments. On the contrary, the invention is intended to cover alternatives, modifications and equivalents, which may be included within the spirit and scope of the invention as defined by the appended claims.

Figure 1:
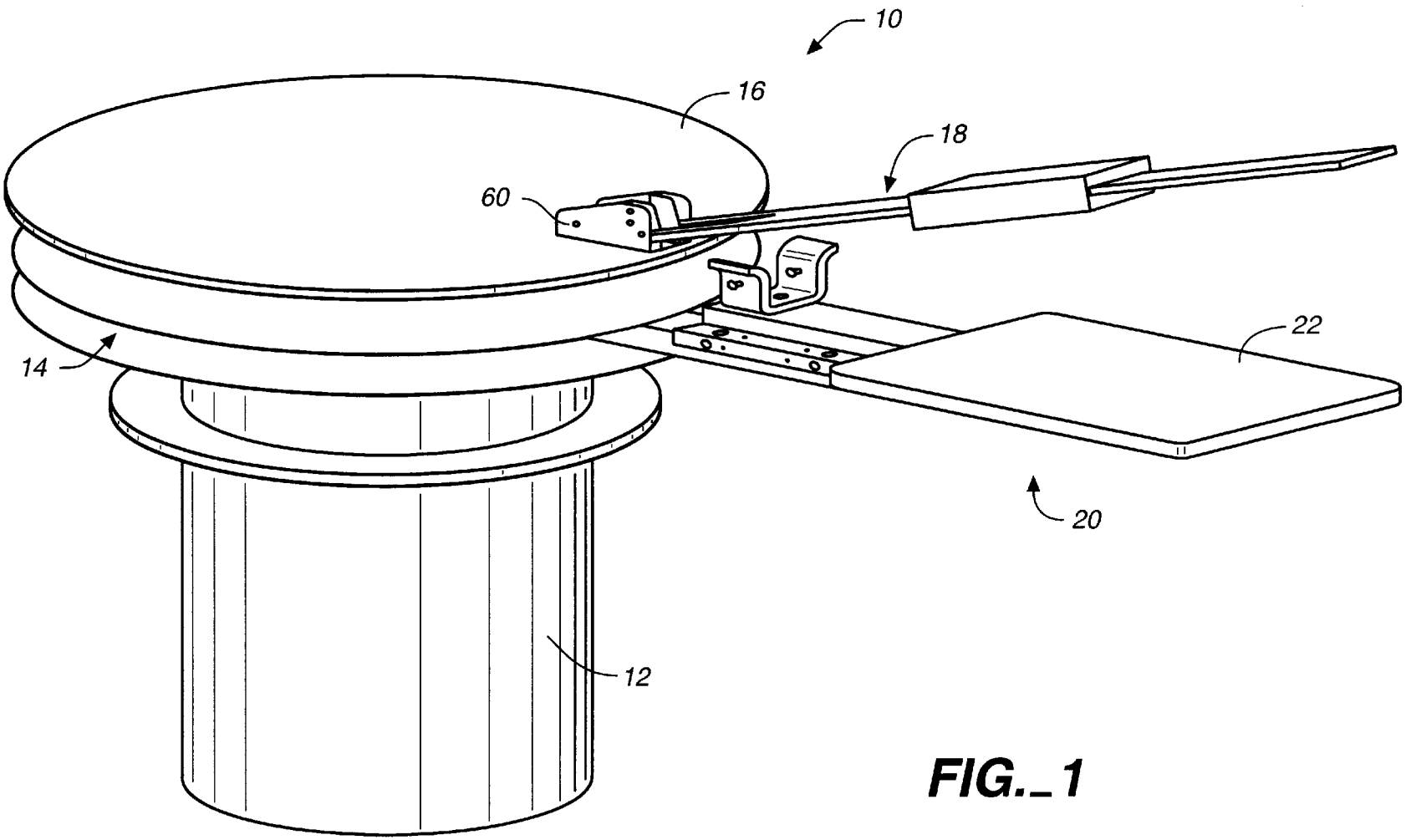
FIG. 1 is a pictorial view of a schematic representation of the press assembly of the present invention, with only one pallet and press arm/printing head shown.

Referring to FIG. 1, the screen printing press assembly of the present invention includes a cylindrical or other base structure 12, a pallet support drum 14 rotatably mounted on a spindle of base structure 12, a press arm wheel 16 independently rotatably mounted on the spindle of base structure 12, a series of vertically pivotable press arm assemblies 18 (only one shown) and a series of movable pallet assemblies 20 (only one shown). Pallet assembly 20 includes a pallet table 22 that functions as a screening station on which screen printing operations take place. Screen printing presses are generally well known and can include 4, 6, 8, 10, 12, or 14 screen stations, although the present invention is not limited by a particular number of stations or press arm assemblies. In fact, the number of screen stations can differ from the number of printing heads. The general features multi-station screen printing press assemblies as shown in the Hopkins/BWM's brochure entitled "6-Axis Hopkins" will not be repeated in detail and are incorporated herein by reference.

Figure 2:
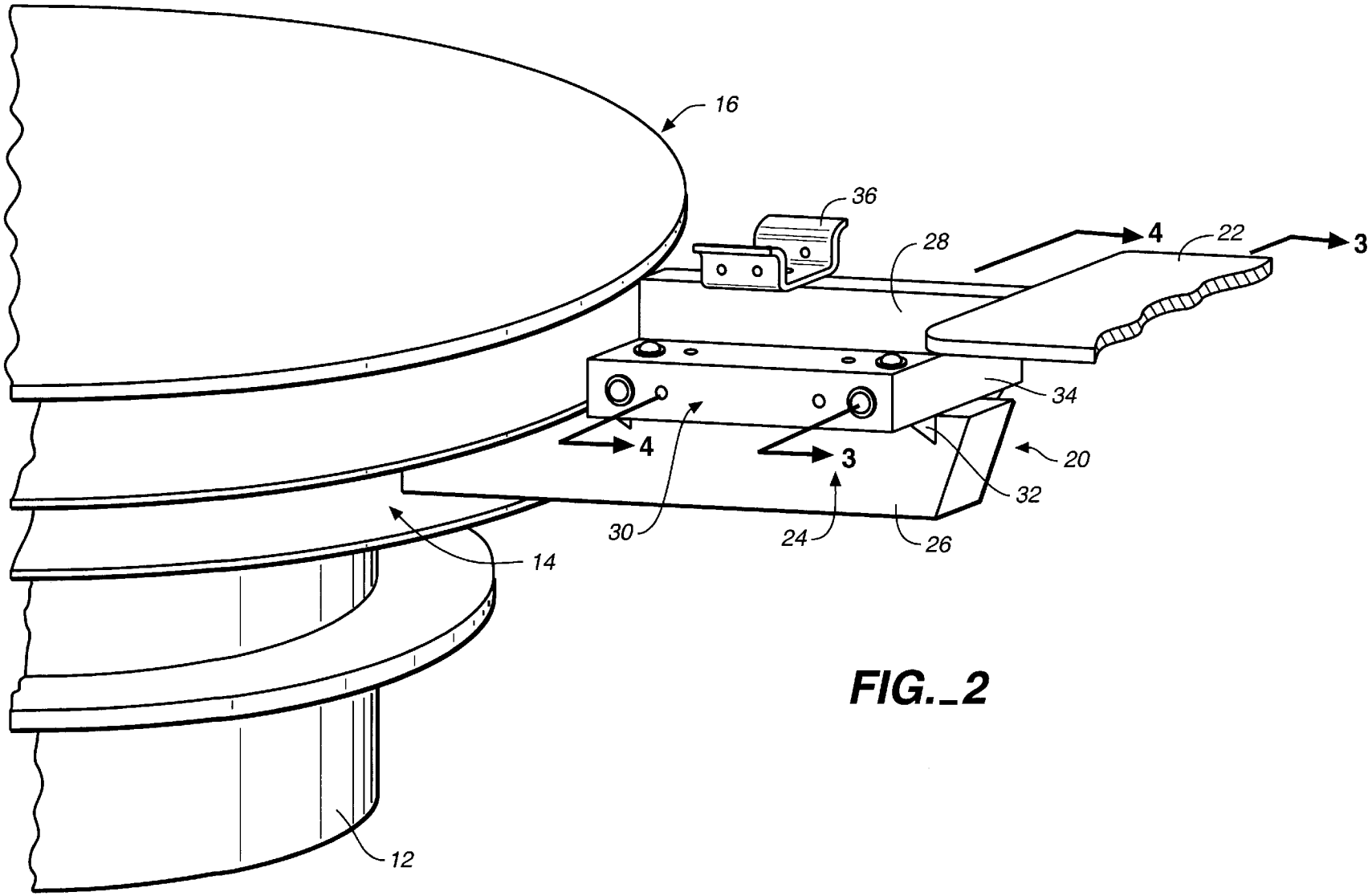
FIG. 2 is an enlarged pictorial view of the pallet arm assembly.

Referring to FIG. 2, pallet assembly 20 includes an adjustable arm mechanism 24, which includes an arm extension bar 26 that is fixedly mounted to and extends radially outwardly from drum assembly 14, a pallet arm 28 that carries pallet table 22, and a laterally and vertically adjustable coupling 30. Coupling 30 includes an inner support plate 32 fixedly secured onto the outer end portion of extension arm 26 and a top cover plate 34, which as discussed herein is adjustably mounted on support plate 32.

A yoke gate 36 is mounted on top of the inner end of pallet arm 28. Yoke gate 36 catches and secures the press arm when its pivoted downward into position over pallet 22. Yoke gates of the type shown are known in the art and the present invention is not meant to be limited to any particular design of yoke gate.

Figure 3:
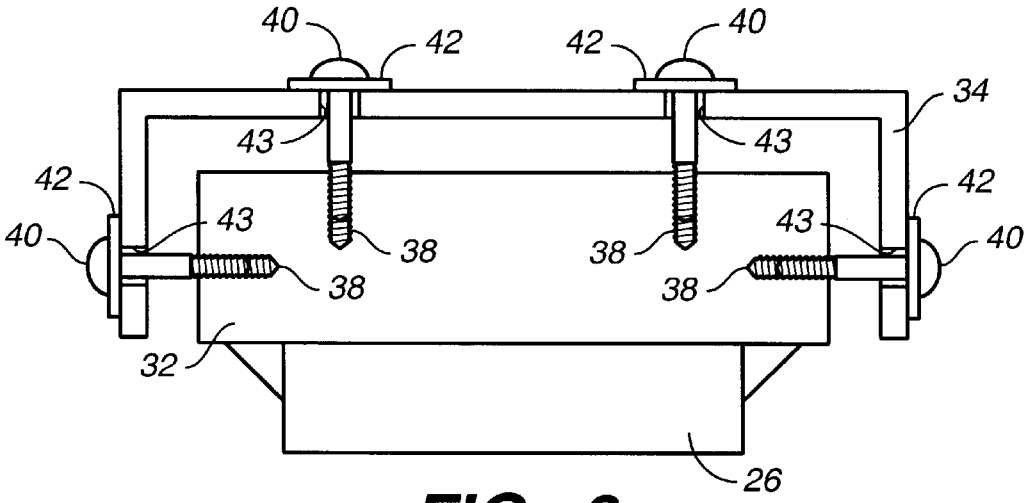
FIG. 3 is a sectional view, taken along the line 3–3 of FIG. 2, of the clamp bolts of the adjustable pallet arm.

Referring to FIG. 3, inner support plate 32 includes a series of threaded bores 38, a total of four bores on top (two in the front and two in the back) and four bores on its sides (two on each side with one in the front and one in the back). Threaded bores 38 receive the inner ends of threaded clamp bolts 40 that each include a washer 42 to assist clamping of top cover plate 34 to inner support plate 32. Threaded bores 38 are sufficiently deep to provide a degree of travel of the clamp bolts yet still retain sufficient contact area between the bolts and the bores for secure attachment of the top cover plate to the support plate.

Each clamp bolt 40 extends through an oversize opening 43 in top cover plate 34. Oversize openings 43 are generally round, but could be slot-shaped, and provide for both lateral and vertical movement of top cover plate 34 relative to support plate 32, as discussed with reference to FIG. 4.

Figure 4:
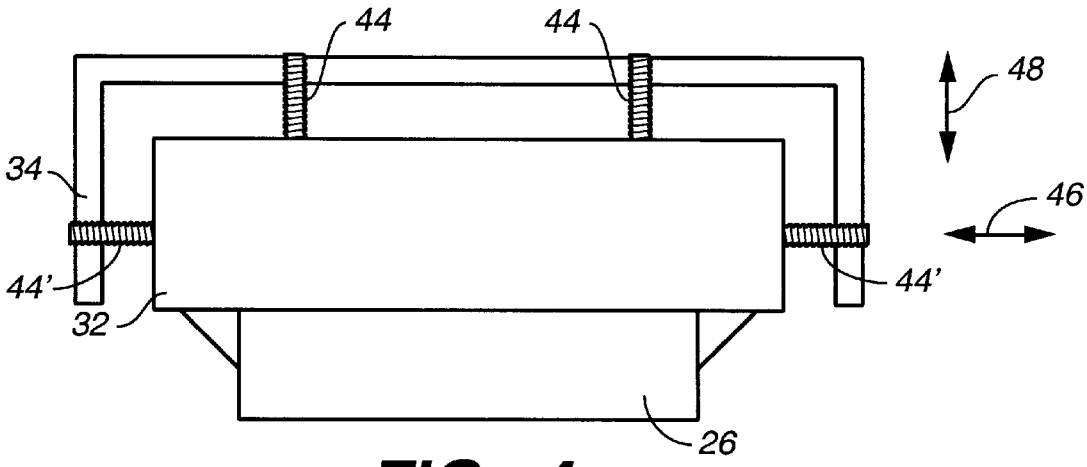
FIG. 4 is a sectional view, taken along the line 4–4 of FIG. 2, of the set screws of the adjustable pallet arm.

Referring to FIG. 4, top cover plate 34 also includes a plurality of set screws 44 (preferably eight with four in back as shown and four in front). Each set screw 44 is preferably positioned adjacent a clamp bolt 38 on a side preferably the inward side, thereof. Set screws 44 are threaded through openings in top cover plate 34 and are sufficiently long for their inner ends to engage support plate 32 for support of the cover on the support plate.

Backing out of clamp bolts 40 allows for adjustment of set screws 44 and therefore adjustment of top cover plate 34 relative to support plate 32. Specifically, backing out of clamp bolts 40 creates a gap between the heads of each clamp bolt 40 and top cover plate 34. This allows set screws 44 to be adjusted in and out as desired to allow for shifting of top cover plate 34 laterally and/or vertically. With clamp bolts 40 backed out, backing in and out of side set screws 44' the lateral position of top plate 34 in the direction of arrow 46, while backing in and out of top set screws 44 adjusts the vertical position of top plate 34 in the direction of arrow 48. Oversize openings 43 in top cover plate 34 permit movement of top cover plate 34 both laterally and vertically without being limited by clamp bolts 40. After repositioning top plate 34, either vertically, laterally or both, clamp bolts 40 are retightened to snug or secure top cover plate 34 down against the set screws in its new adjusted position. The four set screws 44 in the top of cover plate 34 allow the cover plate to be adjusted for pitch and roll, while the side set screws 44' adjust for yaw. Since arm 28 is carried rigidly by cover 34 this allows adjustment of the orientation of platen 22 in a manner described in more detail below.

Figure 5:
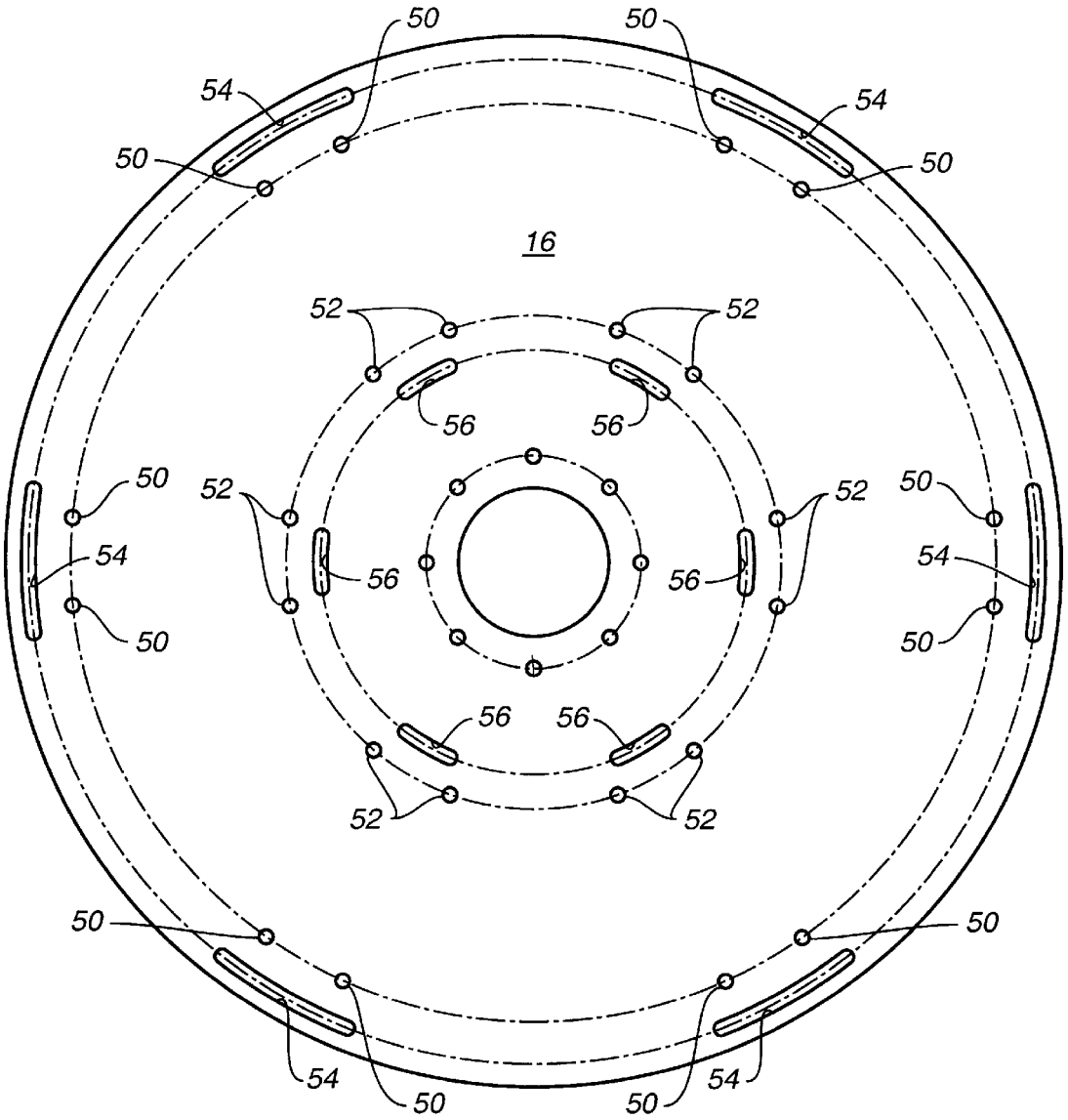
FIG. 5 is a plan view of the press arm support wheel.

As shown in FIG. 5, press arm wheel 16 includes a series of outer through holes 50 and a series of inner through holes 52. As discussed later, these holes receive mounting bolts that provide a degree an angular adjustment of the press arm assemblies for the purpose of capturing them in their respective yoke gates mounted on the pallet arms.

Press arm wheel 16 also includes extended arcuate outer slots 54 and shorter arcuate inner slots 56. Slots 54, 56 receive elongated arcuate bushings (not shown) that provide for reduced friction angular movement of the press arm brackets on wheel 16, as discussed later with reference to FIG. 9. Each of the bushings received in arcuate slots 54 and 56 has a length less than the length of the slots so as to accommodate arcuate movement of the bushings in the slots.

Figure 6:
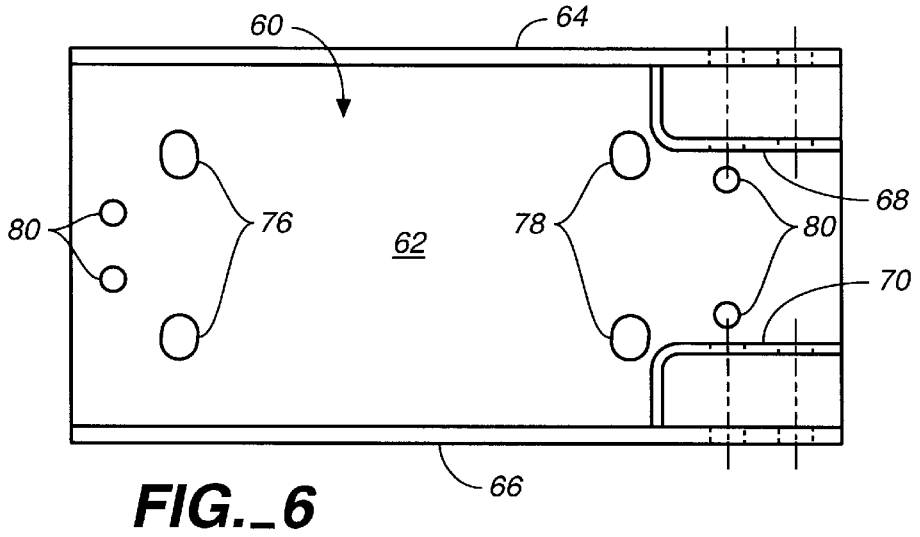
FIG. 6 is plan view of the press arm bracket of FIG. 1.
Figure 7:
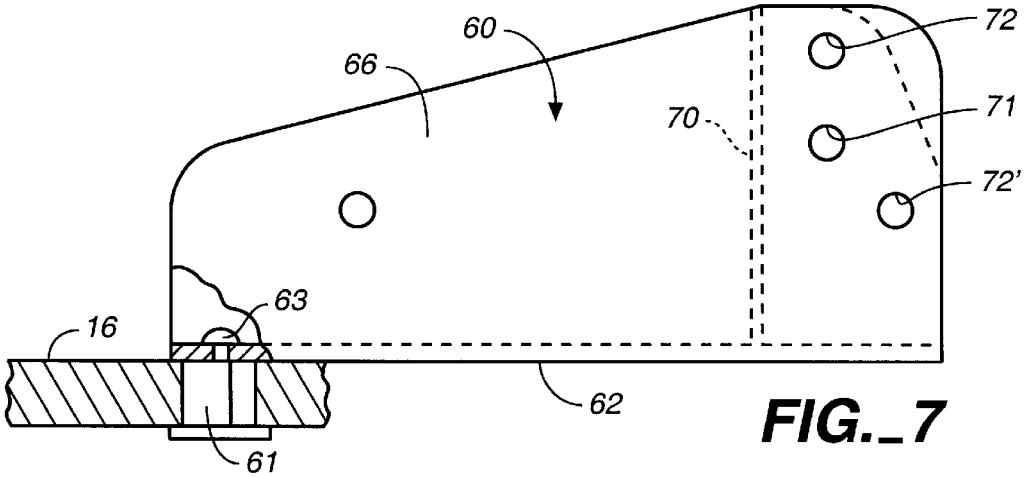
FIG. 7 is a side elevation of the press arm bracket.
Figure 8:
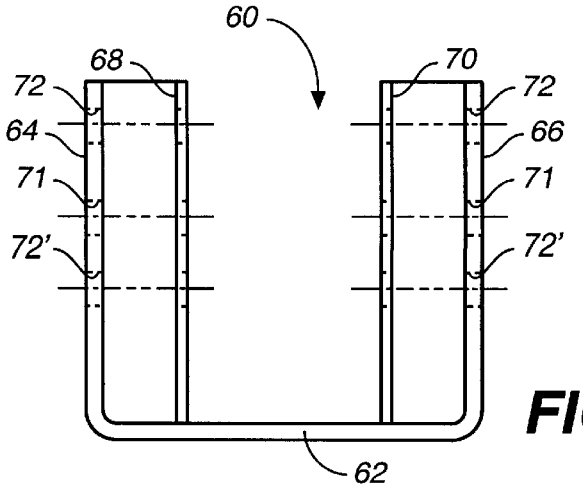
FIG. 8 is an end elevation of the press arm bracket.

Referring to FIGS. 6–8, each press arm assembly is pivotally mounted to the press arm wheel by a press arm bracket 60, which is movably mounted on the press arm wheel. Bracket 60 includes a flat base 62 and integrally formed side walls 64, 66. At the outer end of bracket 60 are a pair of L-shaped interior walls 68, 70. Side wall 64 and interior wall 68 form a first pivotal support for a press arm assembly and side wall 66 and interior wall 70 for a second pivotal support. For this, side walls 64, 66 and interior walls 68, 70 each include a side opening 71 for receiving pivot pins that pivotally mount the inner end of a press arm assembly to bracket 60 at a selected height. Side walls 64, 66 and interior walls 68, 70 also include openings 72, 72', which receive stop brackets (not shown) that limit upward and downward movement of the press arm assembly.

Base 62 includes four oval slots 76, 78 and four threaded openings 80. Oval slots 76, 78 receive mounting bolts (not shown) that secure bracket 60 to the press arm wheel. The arcuate shape of slots 76, 78 permits a degree of angular adjustment of bracket 60, as discussed later. Openings 80 are provided to secure arcuate bushings 61 (FIG. 7) by a fastener 63 which screws into threaded openings in bushings 61. Bushings 61 have a flange 65 thereon which is beneath wheel 16 and they extend upwardly through arcuate openings 54 and 56 so as to allow fasteners 63 to secure the bushings to bracket 60.

Figure 9:
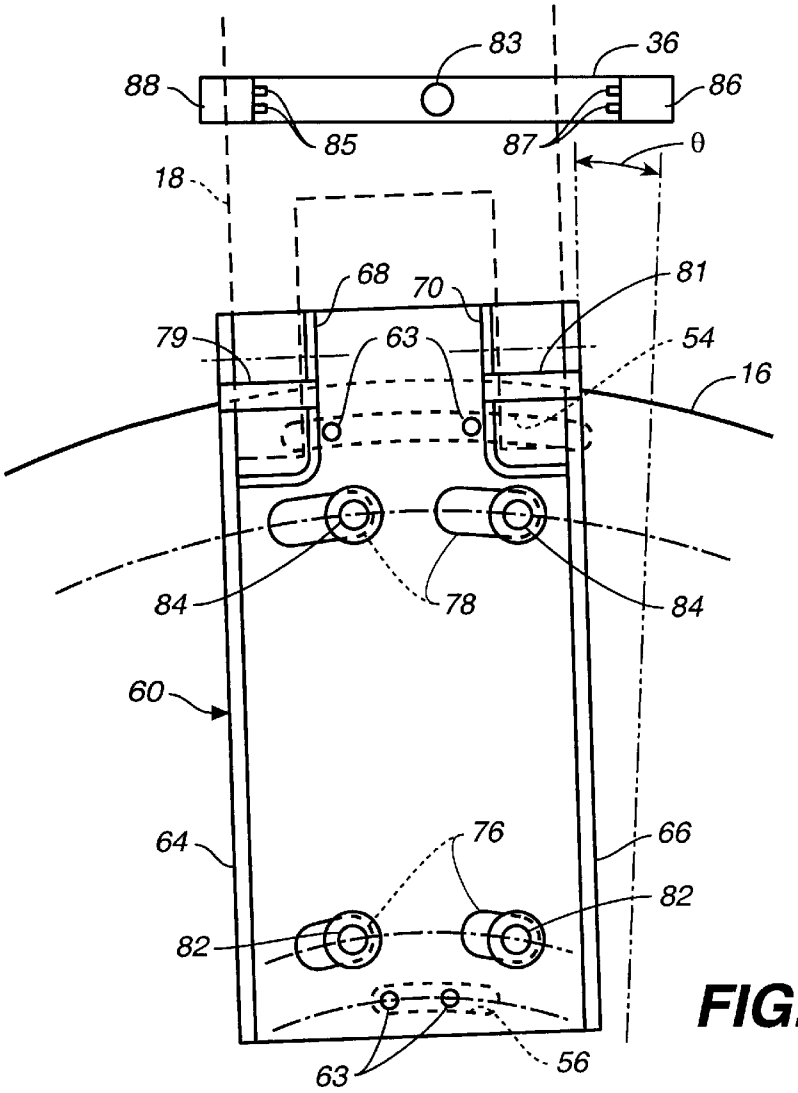
FIG. 9 is an enlarged plan view of a press arm bracket on the wheel of FIG. 5.

Referring to FIG. 9, press arm bracket 60 is shown mounted at and partially overhanging the perimeter edge of wheel 16. Clamp bolts 82, 84 are bolted to wheel 16 and include enlarged heads above slots 76, 78 for preventing bracket 60 from lifting off of wheel 16. Bolts 82, 84 extend down into slots 76, 78, respectively, and are threaded into wheel 16 in a manner providing sufficient play between bracket 60 and wheel 16 to allow bracket 60 to pivot a small degree, as shown by angle θ. Fasteners 63 secure bushings 61 to the bracket so that upon loosening of the bolts 82 and 84 bracket 60 is free for arcuate displacement as guided by bushings 61 in arcuate slots 54 and 56. Slots 54 and 56 are concentric about the center of table 16 so that bracket displacement, which is usually very small (thousandths of an inch), cause the bracket to swing arcuately in an accurate manner. This enables simultaneous adjustment of each arm so that all arms can be in a down position in their respective gates at the same time.

The inner end of press arm assembly 18 is shown in broken lines and is pivotally connected by pins 79, 81 to side walls 64, 66 and interior walls 68, 70 of bracket 60. Press arm assembly 18 extends outwardly over yoke gate 36 and out over the pallet table. Yoke gate 36 includes a pair of side walls 86, 88, between which press arm assembly 18 needs to fit for proper alignment and positioning of the screen press over the pallet table. Yoke gate 36 also includes a bottom stop head 83 upon which the press arm assembly sits when captured by yoke gate 36. Two pairs 85, 87 of laterally adjustable bolt heads allow for adjustment of the gap created between side walls 86, 88 so that the press arm assembly fits snugly into the gate.

As shown in FIG. 9, press arm assembly 18 is misaligned (exaggerated) over yoke gate 36. This can occur when more than one press arm assembly of a multiple station press are simultaneously lowered into position over their respective pallet tables. If bracket 60 were not angularly adjustable, then the first press arm assembly, when lowered and caught by its respective yoke gate, could cause other press arm assemblies to be unable to be lowered into their yoke gates because they are slightly misaligned. Slots 76, 78 provide the necessary angular adjustment of each bracket 60 to reposition its press arm assembly 18 between side walls 86, 88 of yoke gate 36 and bushings 61 guide the angular adjustment.

Figure 10:
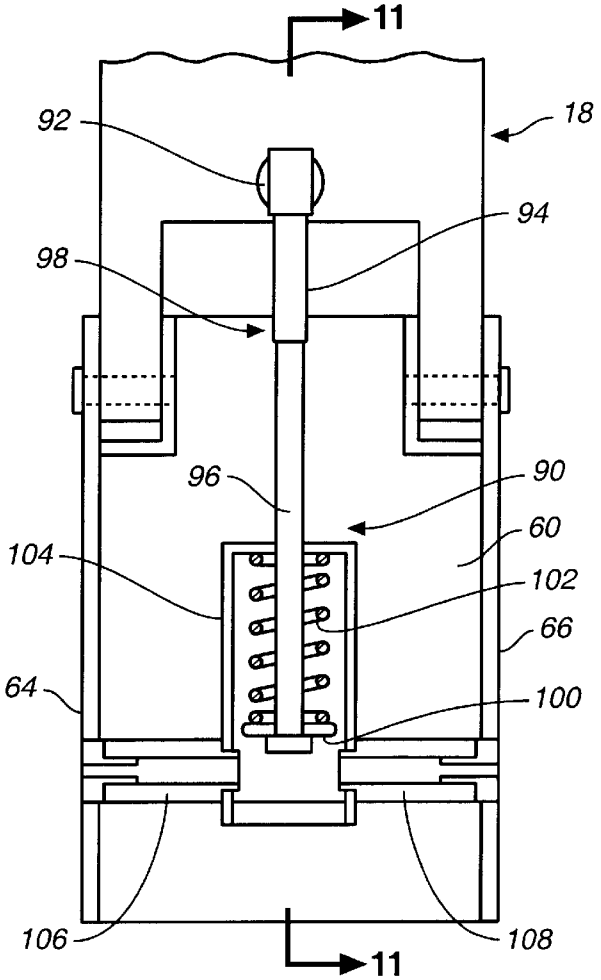
FIG. 10 is a plan view of the press arm bracket of FIG. 8 and the inner end of a press arm pivotally mounted thereto.

Referring to FIG. 10, press arm assembly 18 includes an over-center spring mechanism 90, which was not illustrated in FIG. 9. Spring mechanism 90 includes a rod end universal pivot 92 of the ball and socket type. A rod 94 extends form pivot 92 and connects with an elongated bolt 96 via an adjustable threaded coupling 98, which provides a degree of linear adjustment of the length of the bolt 96 and rod 94 connector. This may be desirable for adjusting spring bias of the press arm assembly, as will be discussed later.

Mounted at the inner end of bolt 96 is a washer 100 and a coil spring 102. A rectangular housing 104 encloses coil spring 102. Housing 104 preferably is made of steel or other metal having sufficient structural rigidity to contain coil spring 102 should the spring fail. Rectangular housing 104 includes a front opening through which bolt 96 extends to connect with rod 94. A pair a lateral, pivotal bushing mounts 106, 108 are mounted between the sides of housing 104 and side walls 64, 66 of bracket 60. Bushing mounts 106, 108 allow housing 104, coil spring 102, bolt 96, and rod 94 to pivot as a unit as press arm assembly 18 is raised and lowered.

Figure 11:
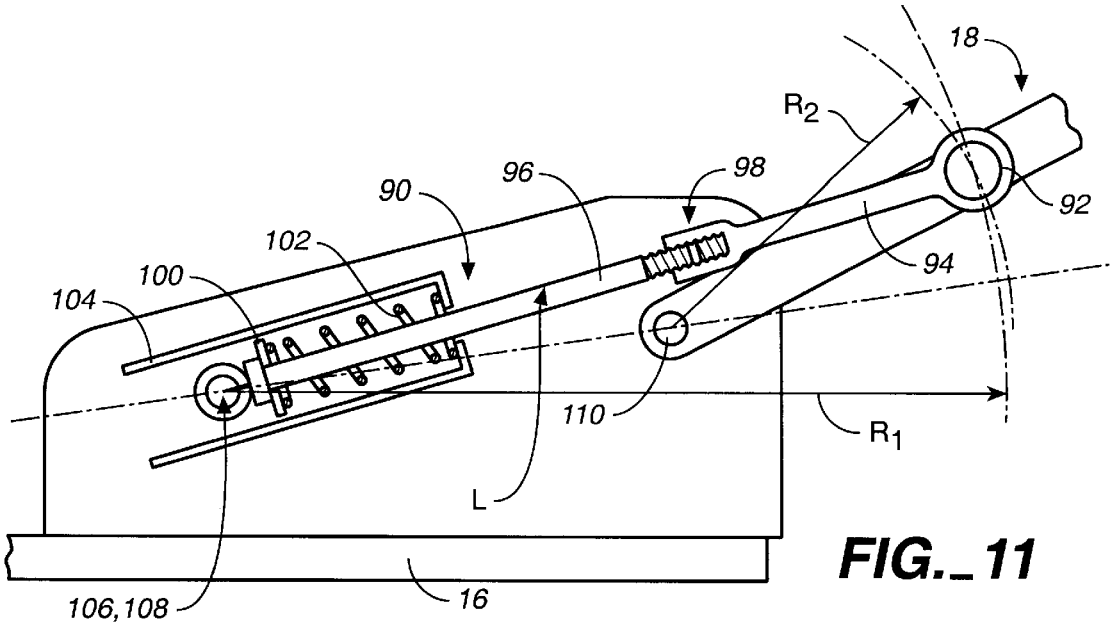
FIG. 11 is a side elevation cut-away view of the press arm bracket and press arm of FIG. 10.

As shown in FIG. 11, rod 94, bolt 96 and housing 104 form an extendable linkage L between bracket 60 and press arm assembly 18. Extendable linkage L pivots about bushing mounts 106, 108 through radius $R_1$. Press arm assembly 18 pivots about pins 110 through radius R2. The ends of linkage L are on opposite sides of pivot 110, which creates an over-center spring bias. When linkage L is aligned with press arm assembly 18, the projection of bolt 96 out of housing 104 is at a maximum and, accordingly, coil spring 102 is compressed to its maximum extent, creating a maximum spring bias. When linkage L is pivoted up above its alignment point with press arm assembly 18, as shown, bolt 96 retracts a short distance into housing 104, and the bias force of coil spring 102 accelerates an upward movement of the press arm assembly. Likewise, when linkage L is pivoted below its alignment point with press arm assembly 18, bolt 96 again retracts into housing 104, and the spring bias of coil spring 102 accelerates a downward movement.

The bias force created by coil spring 102 to raise and lower the press arm assembly can be significant. In prior art systems using over-center coil spring mechanisms, failure of such springs, particularly their connections to the pivoting components of the press arm assembly, has been a safety problem. One proposed solution has been to capture the coil spring in a flexible netting entrained around the coil spring. However, the safety protection provided by such netting is limited.

The over-center spring mechanism of the present invention places the coil spring in compression, which significantly reduces the possibility of spring failure. Also, the rectangular housing of the over-center spring mechanism positively captures the spring in a secure enclosure, thus providing a significantly improved fail-safe design that has sufficient strength to protect against possible machine damage and operator injury due to failure of the coil spring.

Figure 12:
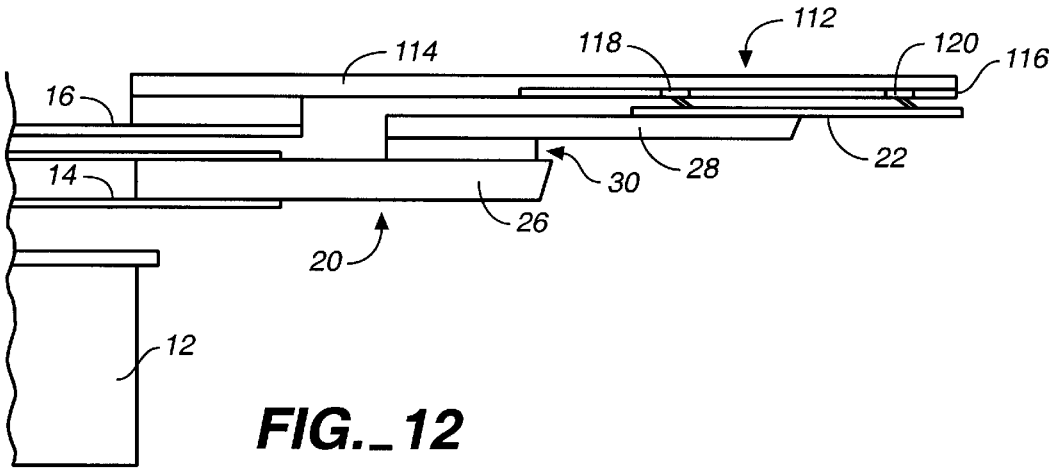
FIG. 12 is an elevation view a pallet and arm support and a leveling board for the press assembly of FIG. 1.

Referring to FIG. 12, a first embodiment of a leveling system 112 is shown. Mounted on wheel 16, at a point angularly between any two adjacent press arm assemblies, is a leveler arm 114. Leveler arm 114 extends outwardly far enough to extend over a pallet table 22 when rotated around over the table. On the underside of leveler arm 114 is mounted a plate 116, which carries a series of dial indicators 118, 120. The mounting of leveler arm 114 of wheel 16 is such that there is a space created between plate 116 and pallet table 22, for example, is on the order of one-tenth of an inch.

If pallet table 22 is not in alignment with rotatable plate 16, adjustable coupling assembly 30 which is carried by pallet arm assembly 20 is adjusted as necessary to bring pallet table 22 into a parallel plane with plate 16. Base structure 12 and rotatable plate (e.g. a spirit level) 16, which carries arm 114, may first be leveled by conventional means, but plate 16 need not be leveled. Table 22 is merely being brought into a plane parallel to table 16 so that the print arms, when rotated by table 16 will always be printing against a table 22 parallel to the rotatable table 16.

Adjustment of coupling 30 can adjust the lateral and vertical positions of pallet table 22, as well as its yaw and pitch. once adjusted, coupling 30 is clamped tight, and once leveled, pallet arm assemblies 20 are properly positioned to receive screen presses carried by all of the press arm assemblies secured to rotating table 16.

Figure 13:
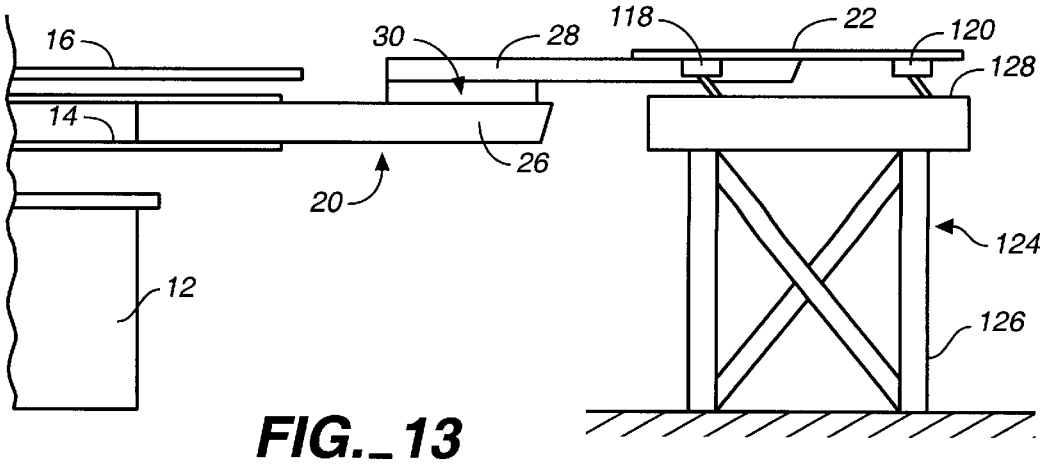
FIG. 13 is an alternative assembly for leveling the pallet.

Referring to FIG. 13, a second embodiment for the leveling system is shown. Leveling system 124 includes a separate table structure 126 with a flat table top 128. In this embodiment, dial indicators 118, 120 are mounted underneath each pallet table 22. Table structure 126 is independently leveled by conventional means. Also, wheel 16 is independently leveled by conventional means by adjusting the mounting of base structure 12.

To properly align a pallet table, each pallet arm assembly 20 is rotated over table top 128 and in position for dial indicators to contact the table top. Adjustment of pallet table 22 is then done in the same manner as discussed for the first embodiment of the leveler system shown in FIG. 12. In this embodiment table 128 and table 16 are both leveled first so that print support tables 22 can be brought into a level condition, which by definition will be parallel to the plane of rotating table 16.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto when read and interpreted according to accepted legal principles such as the doctrine of equivalents and reversal of parts.

What is claimed is:

1. A screen printing press comprising:

a pallet arm assembly for supporting a pallet table for screen printing of articles, the pallet arm assembly including:

(a) a first arm for mounting to a base structure of a screen printing press, the first arm extending outwardly from the base structure, (b) a second arm for supporting the pallet table, and (c) an adjustable coupling joining the first and second arms, the adjustable coupling including a support member secured at the outer end of the first arm and a cover member secured at the inner end of the second arm, the cover member overlying the support member and being adjustable both laterally and vertically with respect to the support member; and a bracket mount for a press arm assembly of the screen printing press, the bracket mount including:

(a) a pivotal mount for securing an end of the press arm assembly in a pivotal manner to a rotatable wheel that carries the bracket mount, the pivotal mount providing angular movement of the press arm assembly from a raised position over a pallet table of the screen printing press to a lowered position where a gate catches the press arm assembly and positions the press arm assembly over the pallet table, and (b) an adjustable coupling for securing the bracket mount to the wheel in a manner that permits a degree of angular movement of the bracket mount so that the press arm assembly can be angularly repositioned to fit into the gate when the press arm assembly is lowered.

2. The screen printing press of claim 1 and further comprising:

an over-center spring mechanism including an extendable linkage pivotally secured at one end to the press arm and at the other end to the bracket mount, with said one end and said other end being positioned on opposite sides of said pivot point, the extendable linkage including a coil spring mounted for compression upon extension of the linkage.

3. A pallet arm assembly for supporting a pallet table for screen printing of articles, comprising:

a first arm for mounting to a base structure of a screen printing press, the first arm extending outwardly from the base structure, a second arm for supporting the pallet table, and an adjustable coupling joining the first and second arms, the adjustable coupling including a support member secured at the outer end of the first arm and a cover member secured at the inner end of the second arm, the cover member overlying the support member and being adjustable both laterally and vertically with respect to the support member.

4. The pallet arm assembly of claim 3 wherein, the adjustable coupling includes adjustable set screws that adjustably position the cover member vertically and laterally with respect to the support member.

5. The pallet arm assembly of claim 4 wherein, the set screws include generally vertically aligned set screws and generally laterally aligned set screws.

6. The pallet arm assembly of claim 4 wherein, the adjustable coupling further includes clamp bolts for tightly securing the cover member to the support member once adjusted in position by the set screws.

7. The pallet arm assembly of claim 6 wherein, a clamp bolt is provided adjacent each set screw.

8. The pallet arm assembly of claim 7 wherein, the set screws include generally vertically aligned set screws and generally laterally aligned set screws.

9. The pallet assembly of claim 3 wherein, the adjustable coupling further provides for adjustment of the yaw and pitch of the pallet table.

10. The pallet arm assembly of claim 9 wherein, the adjustable coupling includes adjustable set screws that adjustably position the cover member vertically and laterally with respect to the support member.

11. The pallet arm assembly of claim 10 wherein, the set screws include generally vertically aligned set screws and generally laterally aligned set screws.

12. The pallet arm assembly of claim 10 wherein, the adjustable coupling further includes clamp bolts for tightly securing the cover member to the support member once adjusted in position by the set screws.

13. The pallet arm assembly of claim 12 wherein, a clamp bolt is provided adjacent each set screw.

14. The pallet arm assembly of claim 13 wherein, the set screws include generally vertically aligned set screws and generally laterally aligned set screws.

15. A bracket mount for a press arm assembly of a screen printing press, comprising:

a pivotal mount for securing an end of the press arm assembly in a pivotal manner to a rotatable wheel that carries the bracket mount, the pivotal mount providing angular movement of the press arm assembly from a raised position over a pallet table of the screen printing press to a lowered position where a gate catches the press arm assembly and positions the press arm assembly over the pallet table, and an adjustable coupling for securing the bracket mount to the wheel in a manner that permits a degree of angular movement of the bracket mount so that the press arm assembly can be angularly repositioned to fit into the gate when the press arm assembly is lowered, the adjustable coupling including a pair of radially spaced coupling slots in one of the bracket mount and the wheel and bolts secured to the other of the bracket mount and the wheel, the bolts extending through the slots and the slots being arcuate to provide guided angular movement of the bracket mount through an arcuate path radially spaced from the center of the wheel.

16. The bracket mount of claim 15 and further comprising arcuate bushings secured between the bracket mount and the wheel and positioned in the arcuate slots for providing low friction angular movement.

* * * * *